United States Patent [19]

Klein

[11] 4,145,968

[45] Mar. 27, 1979

[54] DEVICE FOR THE CONTACTLESS TRANSMISSION OF ELECTRICAL ENERGY, IN PARTICULAR FOR PYROTECHNIC IGNITORS OR FIRING DEVICES

[75] Inventor: Denys C. Klein, Orsay, France

[73] Assignee: Compagnie de Signaux et d'Entreprises Electriques, Paris, France

[21] Appl. No.: 823,538

[22] Filed: Aug. 10, 1977

[30] Foreign Application Priority Data

Sep. 1, 1976 [FR] France ..... 76 26403

[51] Int. Cl.[2] ..... F42C 19/12; F42B 3/04; F42D 1/04

[52] U.S. Cl. ..... 102/46; 102/202

[58] Field of Search ..... 102/28 R, 46, 202, 205, 102/206; 89/28 R; 42/84

[56] References Cited

U.S. PATENT DOCUMENTS

| | | | |
|---|---|---|---|
| 2,459,854 | 1/1949 | Swift, Jr. | 102/46 UX |
| 2,640,417 | 6/1953 | Bjork et al. | 102/46 X |
| 2,690,124 | 9/1954 | Melick | 102/46 UX |
| 3,038,384 | 6/1962 | Gaugler | 102/202 X |
| 3,809,964 | 5/1974 | Ceyrat | 102/28 R |

FOREIGN PATENT DOCUMENTS

| | | | |
|---|---|---|---|
| 2421908 | 12/1974 | Fed. Rep. of Germany | 102/46 |
| 1235844 | 6/1971 | United Kingdom | 102/206 |

*Primary Examiner*—Verlin R. Pendegrass
*Attorney, Agent, or Firm*—Cesari and McKenna

[57] ABSTRACT

An inductive energy transmission device for firing an igniter which has primary and secondary windings and a fixed magnetic screen designed to be generated by the primary winding.

4 Claims, 1 Drawing Figure

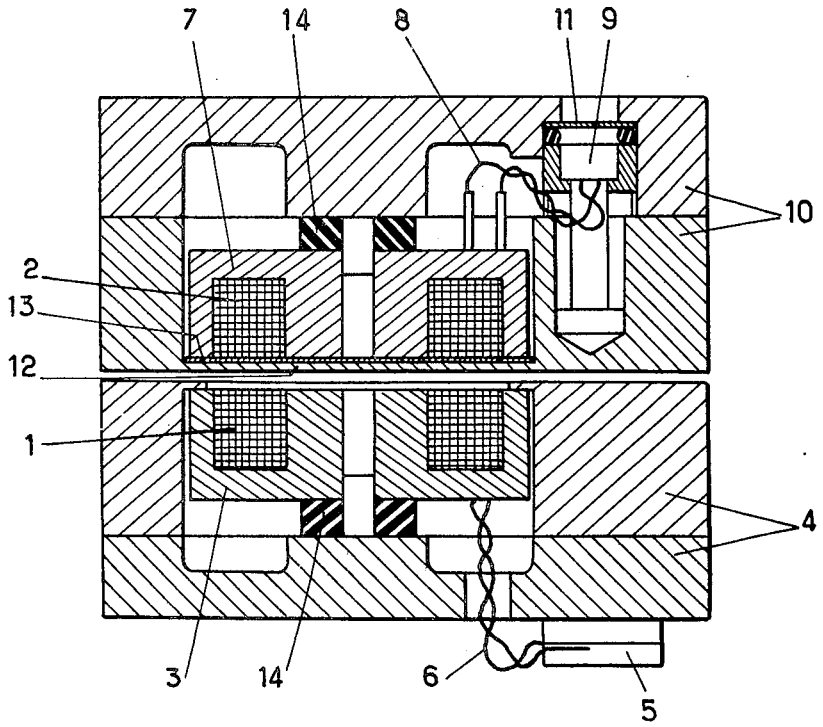
7
14
8
11
9
10
2
13
12
1
4
3
14
6
5

DEVICE FOR THE CONTACTLESS TRANSMISSION OF ELECTRICAL ENERGY, IN PARTICULAR FOR PYROTECHNIC IGNITORS OR FIRING DEVICES

The present invention relates to a device for the contactless transmission of electrical energy, intended in particular to fire an ignitor connected to a pyrotechnic charge, of the type comprising a fixed, control, primary winding capable of being supplied with alternating current, and a secondary winding connected to the electro-ignitor, and arranged on the pyrotechnic charge within a magnetic circuit that is itself enclosed in a protective shield against stray induction currents.

If the precaution is not taken of shielding the secondary winding, it will be exposed to all the environmental radiation each time it is situated opposite the primary winding since its magnetic circuit will then be open. These stray radiations, consisting for example of atmospheric lightening or emissions from broadcasting or radar installations, will be capable of affecting the secondary winding and, if the level of received energy is sufficient, of prematurely firing the pyrotechnic charge.

This is why, in the known devices of this type, the ignitor is generally desensitised by interposing a shield capable of closing on itself the magnetic circuit of the secondary winding and, consequently, of making it immune to the influences of stray external fields.

Of course, the said shield has to be removed by the pyrotechnist involved in firing the charge, so that it will no longer act as a screen at the moment the firing order is given. Conversely, this shield should be able to be replaced each time that, the firing order not having been given, the pyrotechnic charge should be returned to store or to the magazine.

To this end, the shield is generally made so as to slide or pivot on the charge. However, these retractable shields have the disadvantage that their screening mechanism is fragile and the pyrotechnist runs the danger of a premature ignition by an external electromagnetic or magnetic induction between the moment when he retracts the shield and the moment when he makes the magnetic connection between the fixed primary winding and the movable secondary winding.

The main aim of the present invention is thus to eliminate these disadvantages and, in order to carry this out, has as an objective an energy transmission device of the afore-mentioned type which is basically characterised in that the said shield consists of a fixed magnetic screen of magnetically saturable iron designed so as to be saturated in the presence of the control magnetic flux generated by the primary winding.

Thanks to this arrangement, all the disadvantages inherent in the retractable devices are automatically eliminated since there is no mechanism that can jam, corrode, or deform. Furthermore, since the shield according to the invention is permanently fixed on the charge, it ensures in all circumstances, and particularly during the various handling stages of the charge, an excellent immunity against stray inductions.

The secondary winding is preferably completely enclosed in an extremely electrically conducting metal shell which is reduced in thickness at right-angles to the air gap so as to form an electric screen against which is placed the magnetic screen of saturable iron.

An increased protection of the ignitor against stray induction currents is thus clearly obtained.

One embodiment of the invention is described hereinafter by way of example and with reference to the accompanying drawing in which the sole FIGURE is a simplified sectional view of an energy transmission device according to the invention, in its particular application to pyrotechnic ignitors or firing devices.

The device shown here is of the magnetic induction type and essentially comprises a fixed control primary winding 1 combined with a movable secondary winding 2. The primary winding will for example be mounted on a launching ramp for projectiles propelled by pyrotechnic charges, while the secondary winding will be connected to the ignition starter for these charges.

Thus, as may be seen clearly in the FIGURE, the primary winding 1 is arranged in a magnetic circuit 3 of the ferrite pot type, which is itself placed in the interior of a housing 4 integral with the launching ramp, not shown. This primary winding can be supplied with an alternating current voltage of suitable frequency and value by means of connection terminals 5 specially provided for this purpose and to which it is connected by wires 6.

The secondary winding 2 is also located in a magnetic circuit 7 of the ferrite pot type and is connected via wires 8 to an electro-ignitor 9 which, when a fairly high voltage is applied to its terminals, can become sufficiently heated by the Joule effect so as to ignite the pyrotechnic charge. Moreover, the magnetic circuit 7 and the electro-ignitor 9 are completely enclosed in a shell 10 made of an extremely electrically conducting metal, for example of aluminium or copper, which serves as a Faraday cage and which is of course connected by suitable means to the charge, not shown. As regards the electrical ignitor itself, the protection is completed by a thin cover 11 of an extremely electrically conducting metal, which seals the seating of the said ignitor and is capable of deforming in order to transmit the thermal impulse during the spontaneous firing of the charge.

The shell 10 is reduced in thickness at right-angles to the air gap between the two magnetic circuits 3 and 7 so as to form only an electrical screen 12 thick enough to serve as an electrostatic shield with respect to stray signals, but nevertheless sufficiently thin so as not to short-circuit the secondary winding during the planned transmission of a firing order.

In accordance with the invention, a magnetic screen or shunt of saturable iron 13 is placed against the electrical screen 12 on the inner side thereof. It is automatically held in place against the latter by the pressure of the secondary circuit 7, by means of elastic washers such as 14.

At low induction the magnetic screen 13 has a high permeability and short-circuits the lines of magnetic field encircling the secondary winding. It thus prevents the appearance of any appreciable electro-motive force on the terminals of the said secondary winding.

Thus, when it is placed in a stray magnetic flux, i.e. in a weak induction situation, variable or otherwise, the magnetic shunt 13 prevents this flux penetrating the interior of the winding by virtue of the high permeability which it imparts to the external surface layer of the latter. The central core of the ferrite pot 7 is consequently free from any penetration by undesirable flux and is therefore unable to produce an electro-motive force on the terminals of the winding 2 sufficient to fire the electrical ignitor 9.

On the other hand, under strong induction conditions the magnetic screen 13 is saturated and ceases to deflect the field lines, which are then practically totally directed towards the secondary winding.

This is particularly the case when, in order to fire the ignitor, the secondary magnetic circuit 7 is placed concentrically in the primary magnetic circuit 3, i.e. as shown in the FIGURE, and the latter is subjected to a variable flux from an appropriate alternating current voltage applied to the terminals 5 of the primary winding 1.

Of course, if the axial flux which is then generated by the central core of the primary circuit 3 is weak, the magnetic shunt 13 will absorb the greater part thereof and will thus fully carry out its protective role. However, in fact there is no difficulty in obtaining a high axial flux since the application of the firing voltage is extremely short. Consequently, the magnetic shunt 13 is saturated on account of its thinness and everything occurs as if it were absent. The greater part of the flux thus passes through the central core of the secondary circuit 7 and its variation generates an electro-motive force on the terminals of the secondary winding 2 sufficient to ignite the electro-ignitor 9.

Finally, it can be seen that the saturable magnetic shunt 13 according to the invention discriminates purely statically between the firing orders given knowingly and produced by an induction of specific frequency and value, and the stray signals carried electromagnetically, against which it constitutes a practically impermeable screen.

The discrimination between true and false signals may be improved, in a perfected variant of the present invention, by varying the thickness of the magnetic shunt as a function of the radius. The saturation loop is in fact more sharp if the induction is the same at all points of this shunt, which is obtained in practice by decreasing its thickness as its radius increases.

I claim:

1. A device for the contactless transmission of electrical energy, intended in particular for firing an ignitor connected to a pyrotechic charge, of the type comprising a fixed control primary winding capable of being supplied with alternating current, and a secondary winding connected to the ignitor and mounted on the pyrotechnic charge within a magnetic circuit which is itself enclosed in a protective shield against stray induction currents there being an air gap between said windings, characterized in that the said shield comprises a fixed magnetic screen of saturable iron designed so as to be saturated in the presence of the magnetic control flux generated by the primary winding.

2. The device according to claim 1, characterised in that the secondary winding is completely enclosed in a shell of an extremely electrically conducting metal which is thinner at right-angles to the air gap so as to form an electrical screen against which is placed the magnetic screen of saturable iron.

3. The device according to claim 1, characterised in that the thickness of the magnetic screen of saturable iron decreases progressively as a function of its radius.

4. The device according to claim 2, characterized in that the thickness of the magnetic screen of saturable iron decreases progressively as a function of its radius.

* * * * *

UNITED STATES PATENT AND TRADEMARK OFFICE

CERTIFICATE OF CORRECTION

PATENT NO. : 4,145,968

DATED : March 27, 1979

INVENTOR(S) : Denys Ch. Klein

It is certified that error appears in the above-identified patent and that said Letters Patent are hereby corrected as shown below:

Title page, No. [75], "Denys C. Klein" should be --Denys Ch. Klein--.

Title page, Abstract, line 3, "be generated" should be --be saturated in the presence of the magnetic flux generated--.

Signed and Sealed this

*Thirteenth* Day of *November 1979*

[SEAL]

*Attest:*

RUTH C. MASON
*Attesting Officer*

LUTRELLE F. PARKER
*Acting Commissioner of Patents and Trademarks*